US005360513A

United States Patent [19]

Ryham

[11] Patent Number: 5,360,513

[45] Date of Patent: Nov. 1, 1994

[54] SULPHUR REMOVAL FROM GASES ASSOCIATED WITH BOILERS HAVING CASCADE EVAPORATORS

[75] Inventor: Rolf C. Ryham, Rosewell, Ga.

[73] Assignee: A. Ahlstrom Corporation, Noormarkku, Finland

[21] Appl. No.: 834,107

[22] Filed: Feb. 13, 1992

[51] Int. Cl.[5] ..... D21C 11/04

[52] U.S. Cl. ..... 162/30.11; 162/30.1; 162/29; 159/47.3; 159/DIG. 8

[58] Field of Search ..... 162/30.1, 30.11; 159/47.3, DIG. 8; 423/207, 208, DIG. 3

[56] References Cited

U.S. PATENT DOCUMENTS

| | | | |
|---|---|---|---|
| 2,711,430 | 6/1955 | Hagglund et al. | 586/60 |
| 3,425,477 | 2/1969 | Farin | 159/47.3 |
| 3,560,329 | 2/1971 | Nelson et al. | 159/47.3 |
| 3,607,619 | 9/1971 | Hess et al. | 162/30 |
| 3,718,446 | 2/1973 | Brink et al. | 48/111 |
| 3,762,989 | 10/1973 | Timpe | 162/30.1 |
| 4,373,109 | 2/1983 | Olah | 585/639 |
| 4,431,617 | 2/1984 | Farin | 423/232 |
| 4,929,307 | 5/1990 | Kiiskila et al. | 159/47.3 |
| 4,953,607 | 9/1990 | Erkki et al. | 159/13.3 |

OTHER PUBLICATIONS

Babcox & Wilcox "Steamn/Its Generation & Use" FIG. 3 on p. 20–9.

Brian Blackwell; "*Chemical Reactions in Kraft Recovery Boilers*"; *pp. 157 and 158.*

*Primary Examiner*—W. Gary Jones
*Assistant Examiner*—Dean T. Nguyen
*Attorney, Agent, or Firm*—Nixon & Vanderhye

[57] ABSTRACT

Black liquor from a cellulose pulp processing plant is treated, including by using a direct contact (cascade) evaporator, without need for oxidizing the black liquor, without substantial sulphur emissions at the cascade evaporator, and by maximizing the solids content of the black liquor so that the loss of heating value of the black liquor is minimized. The black liquor is heated under temperature and time conditions sufficient to drive off most of the organic sulphur compounds as off gases, which gases are converted primarily to methane and hydrogen sulfide, with the methane separated by selective absorption in white liquor. The black liquor is then stripped of most remaining sulfur by bringing it into stripping contact with flue gases from the recovery boiler, the flue gases taken from downstream of the direct contact evaporator. After stripping, the solids content of the black liquor is increased (as by passing it to another evaporator), then it is led into association with the cascade evaporator, and then passed into the recovery boiler where it is combusted. The sulphur constituents of the off gases from the stripping operation are also passed into contact with white liquor.

9 Claims, 2 Drawing Sheets

SULPHUR REMOVAL FROM GASES ASSOCIATED WITH BOILERS HAVING CASCADE EVAPORATORS

BACKGROUND AND SUMMARY OF THE INVENTION

In chemical recovery plants associated with the production of paper pulp, direct contact evaporators (cascade evaporators) are sometimes associated with the recovery boiler/furnace. In such systems, the black liquor from the pulping process is oxidized and is fed at approximately a 50% total solids concentration to the cascade evaporator. In the evaporator its solids concentration is increased to about 65% (the increase in solids content is limited by the high viscosity of the oxidized black liquor), and then it is fed to the recovery boiler as fuel. This commercial system has a number of disadvantages, including:

- The solids concentration of the black liquor when fed to the boiler is limited due to high viscosity;
- The oxidizing process causes a reduction of the fuel value of the black liquor by wet oxidizing $Na_2S$ to $Na_2SO_4$; and
- There is the potential for sulphur off gases at the cascade evaporator because of the presence of significant amounts of particular sulfur containing chemicals in the black liquor at that stage. This last problem has caused some installations to replace direct contact evaporators that were otherwise properly functioning since it is difficult to remove the sulfur off gases generated at this particular location.

According to the present invention, a method and apparatus are provided for treating black liquor associated with direct contact evaporators to overcome the drawbacks, and solve the problems, set forth above. According to the present invention, it is possible to increase the solids content of the black liquor up to about 80%. Sulfur is removed as $H_2S$ so there is no need to oxidize the black liquor, thereby eliminating the loss of its heating value caused by oxidation, and minimizing the sulfur compounds that reach the direct contact evaporator. Further, the sulfur that is removed can be used in other beneficial ways within the pulp plant.

Some of the more basic aspects of the present invention are the heating of the black liquor—such as disclosed in U. S. Pat. No. 4,929,307 (the disclosure of which is incorporated by reference herein)—to drive off organic sulfur containing gases, such as DMS; removing the sulfur containing compounds from the off gases and using them in the pulp mill—such as disclosed in copending U.S. application Ser. No. 07/651,462, filed Feb. 6, 1991 now abandoned (the disclosure of which is incorporated by reference herein); and passing the black liquor (after heat treatment) into stripping contact with flue gases from the recovery boiler.

According to one aspect of the present invention there is provided a method of treating black liquor from a cellulose pulp producing facility, using a direct contactor evaporator and a recovery boiler having a flue gas discharge, comprising the following steps: (a) Heating black liquor at a temperature and for a time period sufficient to drive the majority of the sulfur containing organic compound gases from the black liquor. (b) Removing substantially the remaining sulfur in the black liquor by utilizing flue gases from the boiler flue gas discharge. (c) Passing the hot flue gases through the direct contact evaporator. (d) After step (b), feeding the black liquor to the direct contact evaporator to increase the solids content thereof; and (e) feeding the increased solids content black liquor to the recovery boiler to effect combustion thereof and produce hot flue gases. Desirably, the flue gases for step (b) are removed from the flue gas discharge at a point of withdrawal; and the method comprises the further step (f) of cleaning the removed flue gases after step (b) to remove the sulfur therefrom, and then returning the cleaned gases to the flue discharge downstream of the point of withdrawal. Also, preferably step (b) is practiced by bringing flue gases from the flue gas discharge, from a point downstream of the direct contact evaporator, into contact with the black liquor.

According to another aspect of the present invention there is provided a method of treating black liquor from a cellulose pulp producing facility, using a direct contactor evaporator and a recovery boiler having a flue gas discharge, comprising the following steps: (a) Heating black liquor at a temperature and for a time period sufficient to drive tile majority of the sulfur containing organic compound gases from the black liquor. (b) Passing the hot flue gases through the direct contact evaporator. (c) After step (a), feeding the black liquor to the direct contact evaporator to increase the solids content thereof. (d) Feeding the increased solids content black liquor to the recovery boiler to effect combustion thereof and produce hot flue gases; and (e) treating the gases with sulfur containing organic compounds to produce sulfur containing chemicals useful in thee pulping of cellulose in the cellulose pulp producing facility. The method also preferably comprises the further step (f), between steps (a) and (c), of stripping off the remaining sulphur from the black liquor, by passing it into contact with flue gases from the recovery boiler.

In the practice of the method of the invention, there may also be the further step of increasing the solids content of the black liquor, as by feeding at least a portion thereof to another evaporator (such as a falling film evaporator) to increase the solids content thereof before it is fed to the cascade evaporator. Normally, the black liquor in step (a) has a solids content of roughly 50%, which is increased to roughly 75-80% prior to feed to the recovery boiler. Step (e) may be practiced by converting the off gases to primarily methane and hydrogen sulfide, and then separating the methane and hydrogen sulfide, e.g. by passing the converted off gases into contact with white liquor from the pulp processing facility, and then using the enhanced sulfidity white liquor in the pulp processing facility.

According to another aspect of the present invention, there is a method of treating black liquor according to the following steps: (a) Stripping off sulphur containing compounds from the black liquor. (b) After step (a), feeding the black liquor to the direct contact evaporator to increase the solids content thereof. ( c ) Feeding the increased solids content black liquor to the recovery boiler to effect combustion thereof and produce hot flue gases; and (d) passing the hot flue gases through the direct contact evaporator. Step (a) is preferably practiced by bringing flue gases from the recovery boiler, from a point downstream of the direct contact evaporator, into contact within the black liquor.

According to yet another aspect of the present invention, apparatus for treating black liquor in a cellulose pulp processing facility is provided. The apparatus comprises the following structures: A recovery boiler having a black liquor inlet and a flue gas outlet, for combusting black liquor fed to the inlet to produce flue gases. A direct contact evaporator. A first conduit leading from the flue gas outlet to the direct contact evaporator, and a second conduit leading downstream from the evaporator. Means for bringing black liquor into stripping contact with hot gases. Means for feeding flue gases from the second conduit to the means for bringing black liquor into stripping contact with hot gases. Means for feeding black liquor to said means for bringing black liquor into stripping contact with hot gases; and means for feeding black liquor from the means for bringing black liquor into stripping contact with hot gases to the direct contact evaporator.

Means for increasing the solids consistency of black liquor (such as a falling film evaporator) may be disposed in the means for feeding black liquor from the means for bringing black liquor into stripping contact with hot gases to the direct contact evaporator. The means for feeding flue gases from the second conduit to the means for bringing black liquor into stripping contact with hot gases may comprise a conduit and a fan in the conduit. There may further be means for heating black liquor to drive off the majority of the organic sulphur compounds therefrom, the heating means connected to the means for feeding black liquor to the means for bringing black liquor into stripping contact with hot gases.

It is the primary object of the present invention to provide for the treatment of black liquor with a cascade evaporator to maximize the fuel value of the black liquor, minimize the possibility of significant sulfur emissions from the evaporator, and/or utilize sulfur from the black liquor in advantageous manners in other parts of the facility. This and other objects of the invention will become clear from the detailed description of the drawings, and from the appended claims.

DETAILED DESCRIPTION OF THE DRAWINGS

Figure 1:
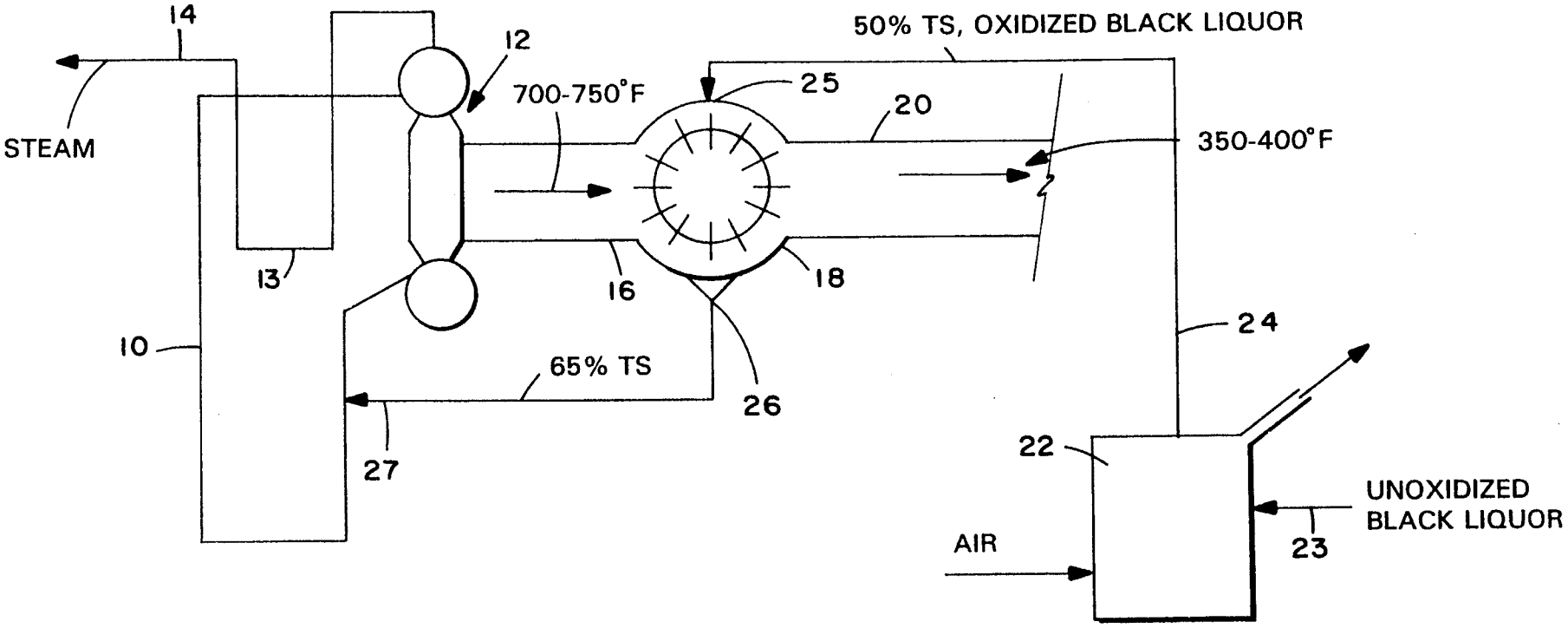
FIG. 1 (PRIOR ART)
FIG. 1 is a schematic view of an exemplary prior art system for oxidizing black liquor and them treating it with a direct contact evaporator.

The conventional commercial system for treating black liquor in a system with a direct contact evaporator is shown schematically in FIG. 1. The recovery boiler 10 is connected to the boiler bank 12 containing steam generating tubes, with steam passing through a superheater 13 and then into line 14 to be used in the pulp producing facility with which the system is associated. A flue gas outlet conduit 16 extends from the boiler 10 to one side of a cascade evaporator 18, with a downstream conduit 20 connected on the opposite side of the cascade evaporator 18.

An oxidizing unit 22 is connected to a line 23 containing black liquor leading from evaporators or a digester, and produces oxidized black liquor which is passed in conduit 24 to the inlet 25 at the top of the cascade evaporator 18. Typically the solids content of the oxidized black liquor in line 24 is 50%, which is increased to about 65% at the discharge 26 from the cascade evaporator 18. From discharge 26 the black liquor is fed in line 27 to the boiler 10 as fuel, which is burned to produce the hot flue gases which produce steam in boiler bank 12, and evaporate the black liquor in direct contact evaporator 18.

Figure 2:
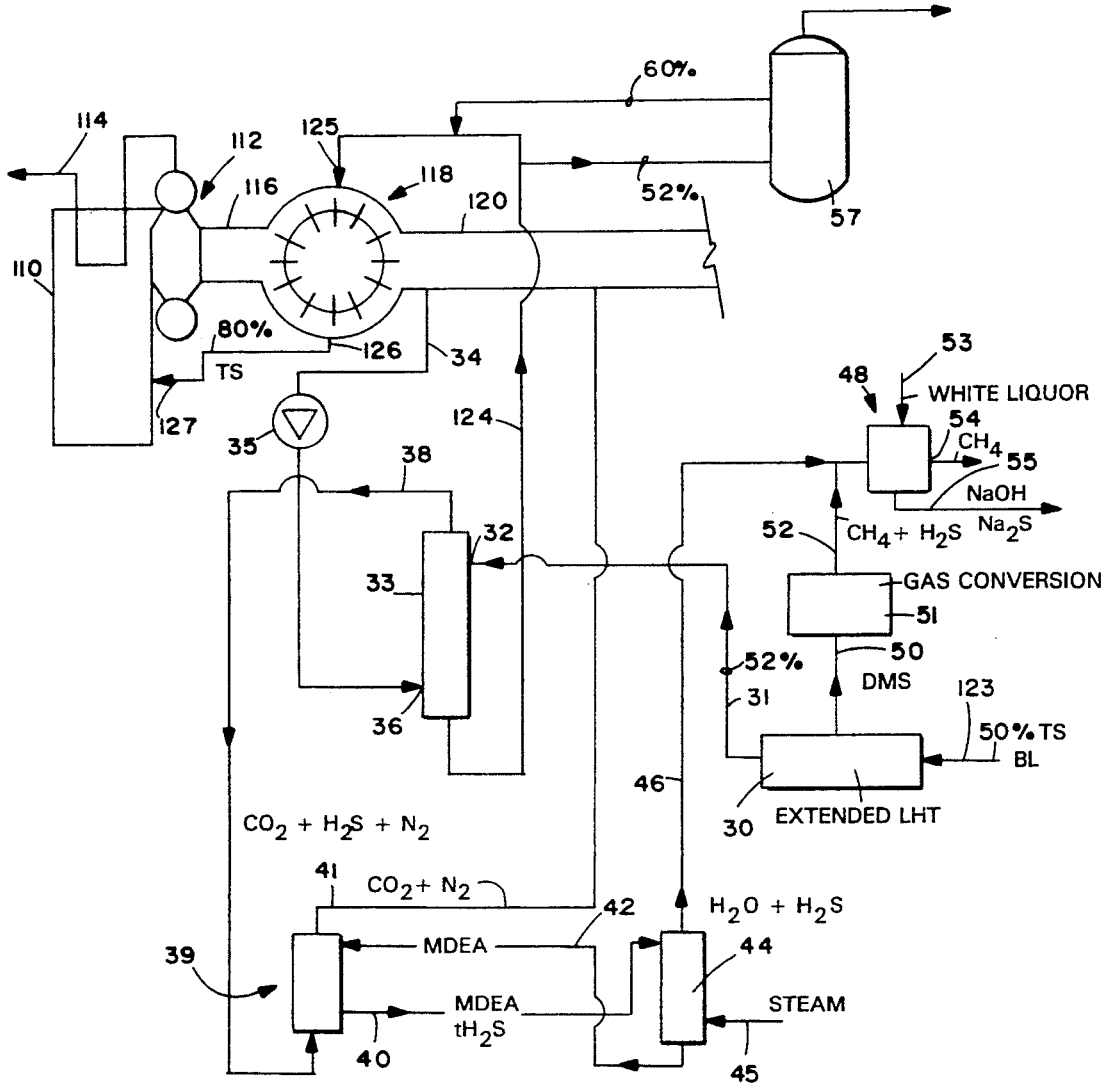
FIG. 2 is a schematic view of an exemplary system for treating black liquor according to the invention.

In the system according to the invention, illustrated in FIG. 2, the oxidizing unit 22 is eliminated. Structures in the inventive system of FIG. 2 that correspond to those in the prior art of FIG. 1 are illustrated by the same reference numeral, only preceded by a "1". The recovery boiler 110 is connected to the boiler bank 112 containing steam generating tubes, with steam passing through a superheater 113 and then into line 114 to be used in the pulp producing facility with which the system is associated. The flue gas outlet conduit 116 extends from the boiler 110 to one side of the cascade evaporator 118, with the downstream conduit 120 connected on the opposite side of the cascade evaporator 118.

According to the invention, the black liquor fed from evaporators, via line 123, is treated in the apparatus 30 by heating the black liquor under pressure, as described in U.S. Pat. No. 4,929,307. This heating is at a sufficient temperature and for a sufficient time period to drive the majority of the sulfur containing organic compound gases from the black liquor (typically 60–70% of the total sulfur content, mostly in the form of DMS), and decreases the viscosity of the black liquor discharged in line 31, typically at about 50% consistency (e.g. 52% solids). The black liquor from treatment apparatus 30 is fed at 32 into stripper means 33. The stripper 33 strips the remaining sulfur in the form of $Na_2S$ from the black liquor to produce hydrogen sulfide. It is believed that this reaction proceeds according to the formula:

$$H_2O+Na_2S+CO_2=Na_2CO_3+H_2S.$$

The medium used for stripping in the stripper 33 preferably is part of the flue gas from flue portion 120. Flue gas from conduit 120 passes in line 34, under the influence of fan 35, to the gas inlet 36 to device 33. The relatively low viscosity stripped black liquor is discharged from device 33 in line 124, for ultimate introduction into evaporator 118 at inlet 125, while gaseous products from the stripper 33 are fed via line 38 to the hydrogen sulfide selective absorber 39. From absorber 39 fluid containing hydrogen sulfide and MDEA (methyldiethanol amine) is discharged in line 40, while carbon dioxide and nitrogen gases are recirculated in line 41 back to conduit 120. MDEA is fed in line 42 to the absorber 39 from vessel 44, steam being supplied at 45 to vessel 44, and water and hydrogen sulfide being discharged from vessel 44 into line 46.

The gases in line 46 are fed to absorber 48. The gases in line 50 from the black liquor heater 30 (primarily DMS, but also other organic sulfur compounds) pass to gas conversion device 51 which—with added hydrogen (as disclosed in copending application Ser. No. 07/756,849 filed Sep. 10, 1991 now pending) converts the DMS and other organic sulfides to primarily methane and hydrogen sulfide, in line 52. The hydrogen sulfide in both lines 46 and 52 is selectively absorbed into the white liquor fed via line 53 into the absorber 48. The methane from absorber 48 passes in line 54 to a utilization station (e.g. the lime kiln ), and the higher sulfidity white liquor in line 55 is used in the pulping process, such as disclosed in copending application Ser. No. 07/788,151 filed Nov. 5, 1991 now abandoned.

A part of the black liquor in line 124 may be fed to another conventional type evaporator 57, such as a falling film evaporator. Because the black liquor has relatively low viscosity (due to heat treatment in device 30), its solids concentration may be increased further than for untreated liquor. This enables the concentration of the liquor flowing into the cascade evaporator 118 to be further increased (e.g. in evaporator 57) so that it is discharged at 126 with a consistency of about 75–80% (i.e. about 10–15% higher than in the prior art). It is then introduced into the recovery boiler 110 at 127 to be burned.

The evaporator 57 may be an integral part of the pre-existing evaporator plant for the mill, or integrated with other heat receiving devices in an effort to optimize the recovery of the secondary vapors generated.

Since substantially all sulfur has been removed from the black liquor before it goes to evaporators 118, 57, there is little pollution at the evaporators themselves. Since there is no oxidation of the black liquor, it retains the highest fuel value possible, which is further enhanced by the fact that the solids consistency thereof when fed to the boiler 110 is higher than in the comparable prior art system. Also, the sulfur removed from the black liquor is beneficially used in the wood pulping process.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of treating black liquor from a cellulose pulp producing facility, using a recovery boiler having a flue gas discharge for discharging hot flue gases and a direct contact evaporator in the flue gas discharge, comprising the steps of:

(a) heating black liquor at a temperature and for a time period sufficient to drive the majority of the sulfur containing organic compound gases from the black liquor;

(b) passing the hot flue gases from the recovery boiler flue gas discharge through the direct contact evaporator; then (c) removing substantially all the remaining sulfur in the black liquor from step (a) by utilizing the hot flue gases from step (b) to strip the sulfur from the black liquor from step (a); then (d) after step (c), feeding the black liquor to the direct contact evaporator to increase the solids content thereof; and then (e) feeding the increased solids content black liquor to the recovery boiler to effect combustion thereof and produce hot flue gases.

2. A method as recited in claim 1 wherein the flue gases for step (c) are removed from the flue gas discharge at a point of withdrawal; and comprising the further step (f) of cleaning the flue gases after step (c) to remove the sulfur therefrom, and then returning the cleaned gases to the flue discharge downstream of the point of withdrawal.

3. A method as recited in claim 1 wherein step (c) is practiced by bringing flue gases from the flue gas discharge, from a point downstream of the direct contact evaporator, into contact with the black liquor.

4. A method as recited in claim 1 comprising the further step (g), between steps (b) and (g), of increasing the solids content of the black liquor.

5. A method as recited in claim 4 wherein the black liquor in step (a) has a solids content of roughly about 50%, and wherein the black liquor from step (d), prior to feed to the recovery boiler, has a solids content of about roughly 75–80%.

6. A method as recited in claim 4 wherein step (g) is practiced by passing at least a portion of the stripped black liquor to an evaporator distinct from the direct contact evaporator.

7. A method as recited in claim 1 comprising the further step (f) of treating the gases generated in step (c), having sulfur containing organic compounds, to produce sulfur containing chemicals useful in the pulping of cellulose in the cellulose pulp producing facility.

8. A method as recited in claim 7 wherein step (f) is practiced by converting the off gases to primarily methane and hydrogen sulfide, and then separating the methane and hydrogen sulfide.

9. A method as recited in claim 8 wherein said separating step is practiced by passing the converted off gases into contact with white liquor from the pulp processing facility, and wherein step (f) is further practiced by using the white liquor in the pulp processing facility.

* * * * *